US011540637B2

(12) United States Patent
Sugano et al.

(10) Patent No.: US 11,540,637 B2
(45) Date of Patent: Jan. 3, 2023

(54) SEAT, CHAIR, AND LOAD SUPPORT BODY

(71) Applicant: KOKUYO CO., LTD., Osaka (JP)

(72) Inventors: Takao Sugano, Osaka (JP); Yojiro Kinoshita, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 0 days.

(21) Appl. No.: 17/331,933

(22) Filed: May 27, 2021

(65) Prior Publication Data

US 2021/0393036 A1 Dec. 23, 2021

(30) Foreign Application Priority Data

Jun. 19, 2020 (JP) ..... JP2020-106454

(51) Int. Cl.

| | |
|---|---|
| ***A47C 3/22*** | (2006.01) |
| ***A47C 3/18*** | (2006.01) |
| ***A47C 3/026*** | (2006.01) |
| ***A47C 7/14*** | (2006.01) |
| ***A47C 7/00*** | (2006.01) |
| ***A47C 7/18*** | (2006.01) |

(52) U.S. Cl.

CPC ..... *A47C 7/144* (2018.08); *A47C 3/18* (2013.01); *A47C 3/22* (2013.01); *A47C 7/004* (2013.01); *A47C 7/18* (2013.01)

(58) Field of Classification Search

CPC ..... A47C 7/144; A47C 3/18; A47C 3/22

USPC ..... 297/219.1, 314, 452.41

See application file for complete search history.

(56) References Cited

U.S. PATENT DOCUMENTS 3,309,137 A * 3/1967 Wiebe ..... A47C 3/18 297/302.1
4,826,247 A * 5/1989 McGrady ..... B64D 11/06 297/314 X
5,577,803 A * 11/1996 Guilbaud ..... A47C 31/126 297/314 X
5,649,740 A * 7/1997 Hodgdon ..... A47C 1/03255 248/575

(Continued)

FOREIGN PATENT DOCUMENTS

DE 295 20 565 U1 2/1996
DE 202010006149 U1 7/2010

(Continued)

OTHER PUBLICATIONS

Extended (Partial) European Search Report dated Feb. 17, 2022, issued in counterpart EP application No. 21177367.6. (9 pages).

*Primary Examiner* — Rodney B White
(74) *Attorney, Agent, or Firm* — WHDA, LLP

(57) ABSTRACT

To realize a noble, useful seat with a simple structure designed to follow a natural movement of a seated person in front-rear and left-right directions and to support appropriately a movement of the person continuously changing its posture while the person balances a load. The seat includes the elastic support layer 3 and upper and lower base units 4 and 5 arranged to sandwich the elastic support layer 3. The upper base unit 4 includes the rolling surface 42*e* bulging toward the lower base unit 5 thereabove via the elastic support layer 3, is rollable in a 360° direction from the tilt reference position IRP in receiving a load of the seated person, and has a moving distal end side tilting more downward as a distance from the position IRP increases, and is configured to move while compressing the elastic support layer 3 by the rolling surface.

16 Claims, 12 Drawing Sheets

(56) References Cited

U.S. PATENT DOCUMENTS 5,769,492 A * 6/1998 Jensen ..... A47C 9/002 297/314 X
5,836,654 A * 11/1998 DeBellis ..... A61G 5/1043 297/440.22
6,176,548 B1 * 1/2001 Thole ..... A47C 9/002 297/329
6,206,335 B1 * 3/2001 Huber ..... A47C 21/006 297/314 X
6,209,958 B1 * 4/2001 Thole ..... A47C 3/026 297/325
6,398,303 B1 * 6/2002 Herrmann ..... A47C 9/002 297/314
6,413,194 B1 * 7/2002 Gant ..... A47C 7/021 5/654
6,685,268 B2 * 2/2004 Meyer ..... A47C 9/002 297/314 X
6,688,689 B1 * 2/2004 Thorn ..... A47C 7/14 297/314 X
7,100,983 B1 * 9/2006 Gant ..... A47C 3/025 297/314 X
7,374,517 B2 * 5/2008 Lockett ..... A63B 26/003 482/146
7,686,396 B2 * 3/2010 Schaaf ..... A47C 7/446 297/314 X
7,789,463 B2 * 9/2010 Gang ..... A47C 9/002 297/314 X
7,806,479 B2 * 10/2010 Jensen ..... A47C 9/002 297/344.14
7,922,247 B2 * 4/2011 Dickie ..... A47C 7/14 297/314 X
8,439,442 B2 * 5/2013 Highlander ..... A47C 7/14 297/314 X
8,888,184 B2 * 11/2014 Meyer ..... A47C 1/03255 297/325
9,084,494 B2 * 7/2015 Riach ..... A47C 20/026
9,107,505 B1 8/2015 Ma
9,289,067 B2 * 3/2016 Meyer ..... A47C 7/14
9,839,296 B2 * 12/2017 Ballendat ..... A47C 7/44
10,213,024 B2 * 2/2019 Reinhard ..... A47C 9/02
10,219,628 B2 * 3/2019 Reinhard ..... A47C 3/22
10,588,415 B2 * 3/2020 Carey ..... A47C 7/021
10,610,021 B2 * 4/2020 Toland ..... A47C 3/04
11,103,072 B2 * 8/2021 Rheault ..... A47C 9/007
2014/0162859 A1 * 6/2014 Cheng ..... A63B 26/003 482/142
2021/0000259 A1 * 1/2021 Mascull ..... A47C 7/144

FOREIGN PATENT DOCUMENTS

JP 2009-82521 A 4/2009
JP 2009-297319 A 12/2009

* cited by examiner

SEAT, CHAIR, AND LOAD SUPPORT BODY

CROSS-REFERENCE TO RELATED APPLICATIONS

This application claims priority of Japanese Patent Applications No. 2020-106454 filed on Jun. 19, 2020. The contents of the applications are incorporated herein by reference in their entirety.

BACKGROUND

Field of the Invention

The present invention relates to a seat which is suitably used in an office or the like and is tiltable in front-rear and left-right directions and relates also to a chair and a load support body.

Description of the Related Documents

Examples of a chair having a seat being tiltable in front-rear and left-right directions and utilizing a cushioning effect include chairs disclosed in Japanese Unexamined Patent Application Publication No. 2009-82521 (hereinafter, referred to as Patent Document 1) and Japanese Unexamined Patent Application Publication No. 2009-297319 (hereinafter, referred to as Patent Document 2).

Patent Document 1 describes a configuration in which a plurality of fluid bags are connected by a flow path and a seat is tilted when air moves.

Patent Document 2 describes a configuration in which a plurality of independent air cushions are covered with a cover member and fitted into a recess of a seat to provide a cushioning property to a user sitting in a chair.

However, in the configurations of Patent Document 1 and Patent Document 2, the seat can move freely due to the cushioning effect, but on the contrary, the degree of freedom of deformation of the seat is too high for a seated person to hold his or her posture on the seat, and therefore, the seated person needs to follow a movement of the seat rather than the seat following a movement of the seated person. As a result, the conventional seats are not designed suitably for supporting a movement of the seated person continuously changing a his or her posture while the seated person balances a load.

The present invention has been accomplished in view of such a problem, and an object thereof is to achieve an unprecedented seat, chair, and load support body with a simple structure designed to follow a natural movement of a seated person in front-rear and left-right directions, and to support appropriately a movement of the seated person continuously changing his or her posture while the seated person balances a load.

SUMMARY

The present invention adopts the following means to achieve such an object.

That is, a seat according to the present invention includes an elastic support layer, an upper base unit and a lower base unit arranged to sandwich the elastic support layer, in which in at least one of the upper base unit and the lower base unit, a rolling surface bulging toward the other of the upper base unit and the lower base unit is arranged above the other of the upper base unit and the lower base unit via the elastic support layer, and the upper base unit is rollable in a 360° direction from a tilt reference position in receiving a load of a seated person, has a moving distal end side tilting more downward as a distance from the tilt reference position increases, and moves while compressing the elastic support layer by the rolling surface.

With this configuration, the rolling surface of the upper base unit rolls above the lower base unit, and thus, the upper base unit can move relatively widely while rolling continuously and smoothly in front-rear and left-right directions according to the movement of the seated person. This allows the seated person to perform a stable tilting motion while balancing the load of the seated person on the rolling surface, resulting in ensured safety. Moreover, the moving distal end side of the upper base unit tilts downward, and thus, it is possible to follow the natural posture change of the seated person.

The seat according to the present invention is formed to only sandwich the elastic support layer between the upper base unit and the lower base unit, and thus, the structure is simple, and the elastic support layer is sandwiched between the both base units, and therefore, the upper base unit rolls on the elastic support layer, and as a result, as compared to a case where the upper base unit rolls directly on the lower base unit, it is possible to obtain a softer sitting feel and also prevent an abnormal noise from occurring. As the moving distal end side tilts downward, the elastic support layer is compressed, and thus, even with the structure where the upper base unit easily rolls on the rolling surface, the cushioning effect of the elastic support layer allows for ensured safety and prevents a situation where the upper based unit cannot return from a rolling destination, and as a result, the upper base unit can be appropriately returned to the tilt reference position by utilizing an elastic restoration motion of the elastic support layer.

To ensure that the upper base unit automatically returns to the tilt reference position by gravity, it is preferable that the center of gravity rises as a distance from the tilt reference position increases.

To increase the cushioning effect by compressing the elastic support layer in any direction and increasing a compression speed of the elastic support layer as the upper base unit tilts, it is preferable that the substantially entire surface of the rolling surface contacts the elastic support layer.

To realize appropriate sway of the upper base unit according to the movement of the seated person in the front-rear and left-right directions, it is preferable that the rolling surface has different curvatures between the front-rear direction or the left-right direction.

For a similar purpose, it is preferable that the rolling surface has different curvatures between a front and a rear.

When a tilt angle of the upper base unit is increased in a narrow space, the upper base unit and the lower base unit have rolling surfaces bulging toward each other, and the upper base unit moves while compressing the elastic support layer between the rolling surfaces.

Further, to ensure safety, it is preferable that the elastic support layer has a damper effect.

The elastic support layer is preferably configured by a load support body in which a resin foam elastic body is wrapped with a skin material having breathability.

The elastic support layer utilizes an inflow and outflow of air, and thus, it is possible to secure a required amount of compressive deformation and an appropriate tilting range of the upper base unit as compared to a case where air is confined.

If elastic characteristics of the resin elastic foam body configuring the elastic support layer and an air permeability of the skin material are appropriately set, even without using a temperature-dependent or humidity-dependent material such as a memory foam mat, it is possible to adjust the elastic support layer to have a moderate cushioning property neither too soft nor too hard and a damper action. As a result, it is possible to realize a seat having an excellent cushioning property when sitting in a chair and having excellent shock-absorbing characteristics, stability, and safety by gently following the movement of the seated person.

To realize appropriate support for each support region of the elastic support layer, it is preferable that the elastic support layer is configured by arranging a plurality of the load support bodies.

To ensure a simple structure and contribute to the optimization of the damper action, it is preferable that each of the load support bodies has a fan shape in a plan view, and the elastic support layer is formed by arranging each of the load support bodies radially around the tilt reference position.

To prevent the load support body from losing its shape, suppress rattling during operation, and enhance the damper function, it is preferable that the elastic support layer is formed of a plurality of layers on top of one another and the load support body configuring each of the layers is arranged around the tilt reference position with a pitch shifted in a circumferential direction.

To allow tilting characteristics to be set freely in the front-back and left-right directions, it is preferable that a load support body constitutive parameter such as a size, a material, a shape of the resin foam elastic body and an air permeability of a skin material is different between the load support body arranged in the front and rear directions and the load support body arranged in the left and right directions.

To prevent the load support body from deviating or peeling due to a force in a rotational direction, it is preferable that in the load support body, a top surface is fixed to the upper base unit and a bottom surface is fixed to the lower base unit.

To alleviate a shock caused when sitting in a chair, it is preferable that the upper base unit sinks while compressing the elastic support layer when receiving the load of the seated person.

To allow for free tilting of the upper base unit in a normal situation and appropriately regulate an excessive tilting motion, it is preferable that the seat is configured such that an opening is provided at a center part of either the upper base unit or the lower base unit, a stopper shaft is provided in the other of the upper base unit and the lower base unit, the stopper shaft is inserted into the opening, the stopper shaft is relatively movable freely within the opening, and if the upper base unit is tilted beyond a predetermined tilting range, the stopper shaft abuts against a peripheral edge of the opening.

To realize a motion of the upper base unit sinking toward the lower base unit when sitting in a chair and appropriately regulate an ascending motion of the upper base unit when the seated person leaves the seat, it is preferable that the opening is provided at the center part of either the upper base unit or the lower base unit, the stopper shaft is provided in the other of the upper base unit and the lower base unit, the stopper shaft is inserted into the opening, and an extraction prevention member arranged on the stopper shaft engages with the peripheral edge of the opening to function as a stopper when the upper base unit separates from the lower base unit during elastic restoration of the elastic support layer.

To easily provide a seat reference position returning function when the seated person leaves the seat, it is preferable that the peripheral edge of the opening and the extraction prevention member of the stopper shaft are engaged in a tapered manner to position the upper base unit in a predetermined posture.

If a chair is configured by using the above-described seat, it is possible to realize a chair having an excellent cushioning property when sitting in a chair and having excellent shock-absorbing characteristics and stability by gently following the movement of the seated person.

By utilizing the above seat, it is possible to realize a similar function also in a chair with the seat supported by a leg having a caster.

By utilizing the above seat, it is possible to realize a similar function also in a chair with the seat supported by the leg and the lower base unit placed on an upper end side of the leg.

Further, as described above, if a plurality of load support bodies formed by wrapping a non-low-resilience resin foam elastic body with a skin material having breathability are dispersedly arranged at positions where a load of a seat is supported to dispersedly support the load, it is possible to independently define a region where a damper effect is produced, to avoid a situation where air moves only inside the elastic support layer, and to appropriately support a load transfer in front-rear and left-right directions through cooperation with each load body.

In that case, in a specific embodiment of the skin material, the skin material preferably has an air permeability of 200 to 500 s.

The present invention has the configuration described above, and thus, it is possible to provide a noble, useful seat, chair, and load support body with a simple structure designed to follow a natural movement of a seated person in front-rear and left-right directions, and to support appropriately a movement of the seated person continuously changing his or her posture while the seated person balances a load.

DETAILED DESCRIPTION

A first embodiment of the present invention will be described below with reference to the drawings.

Figure 1:
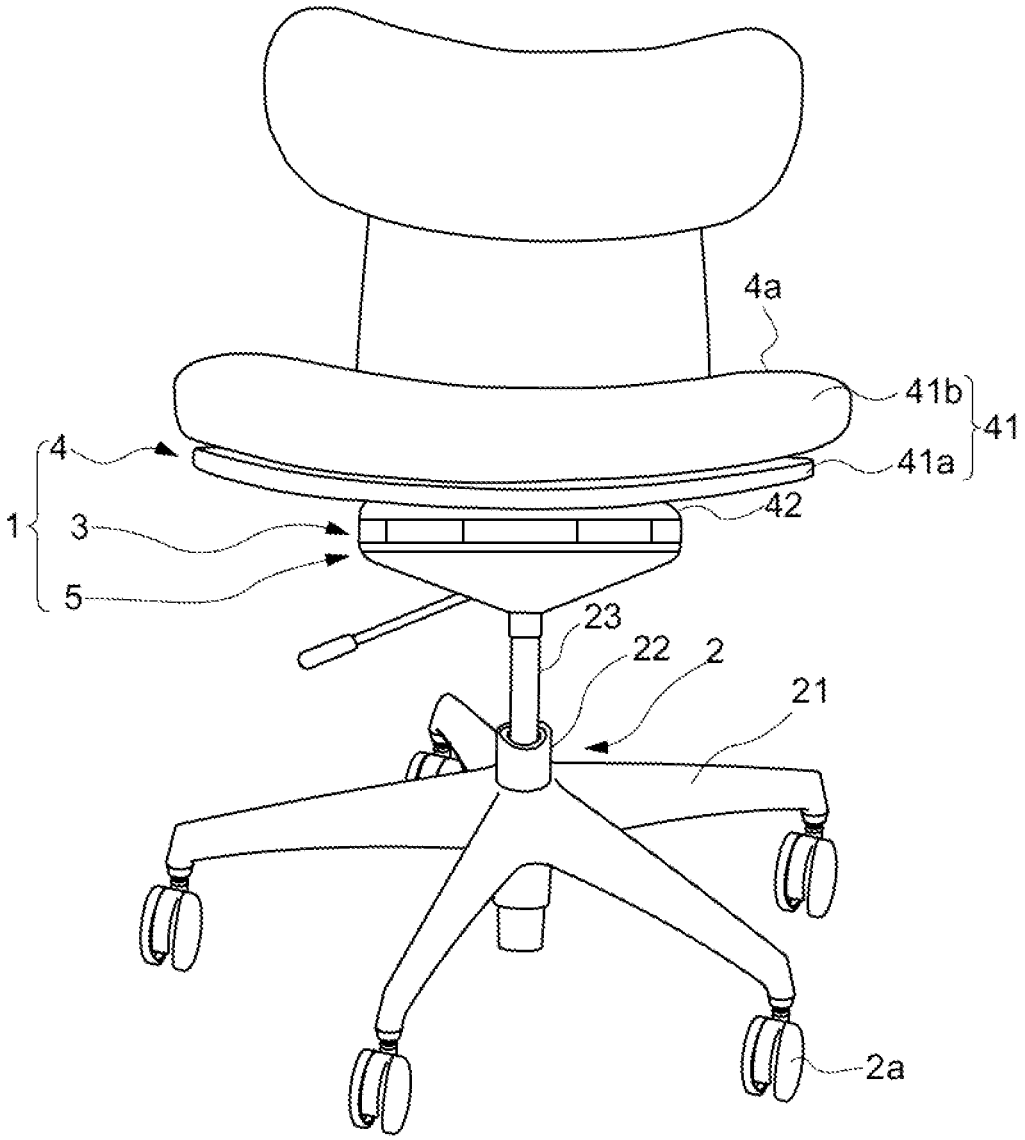
FIG. 1 is a front view illustrating a chair according to an embodiment of the present invention.
Figure 2:
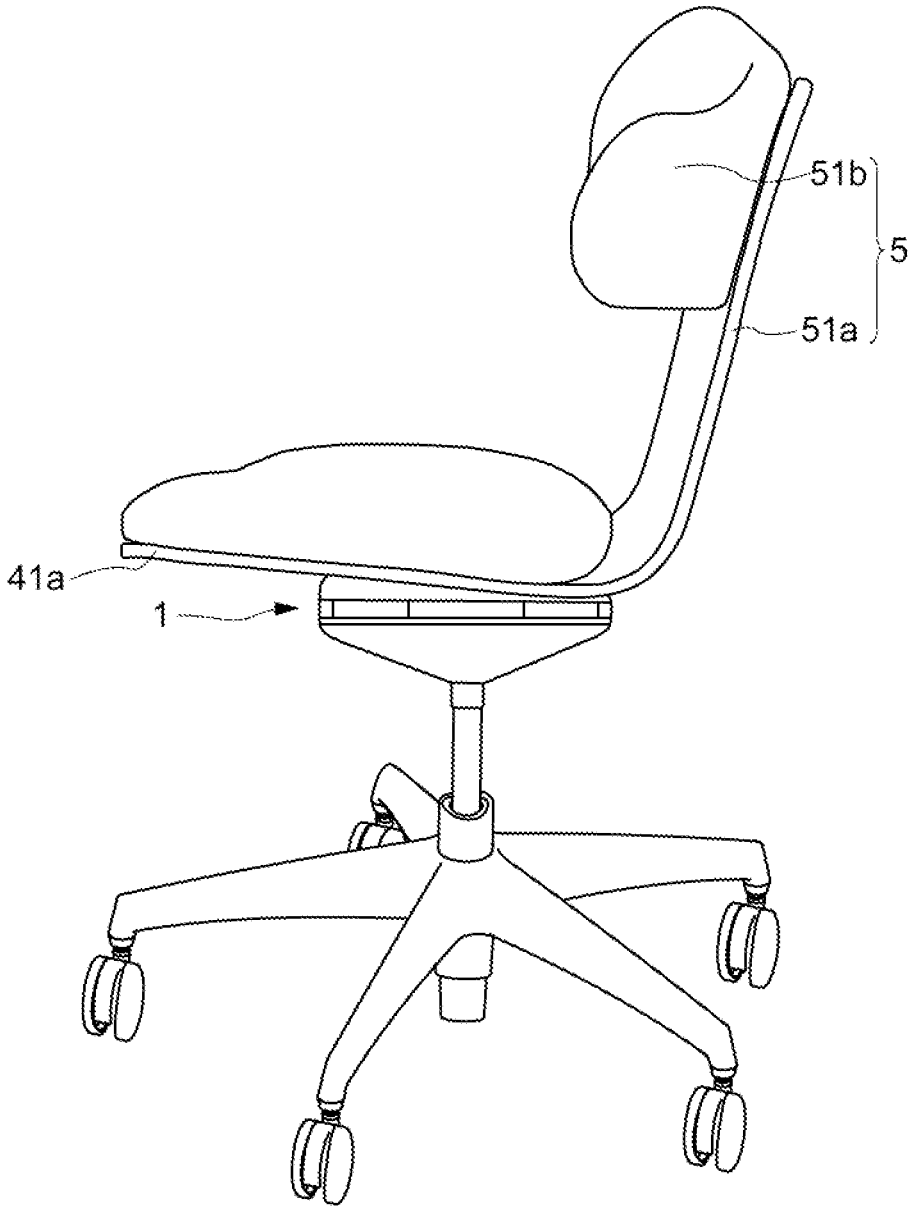
FIG. 2 is a right side view of the chair.
Figure 3:
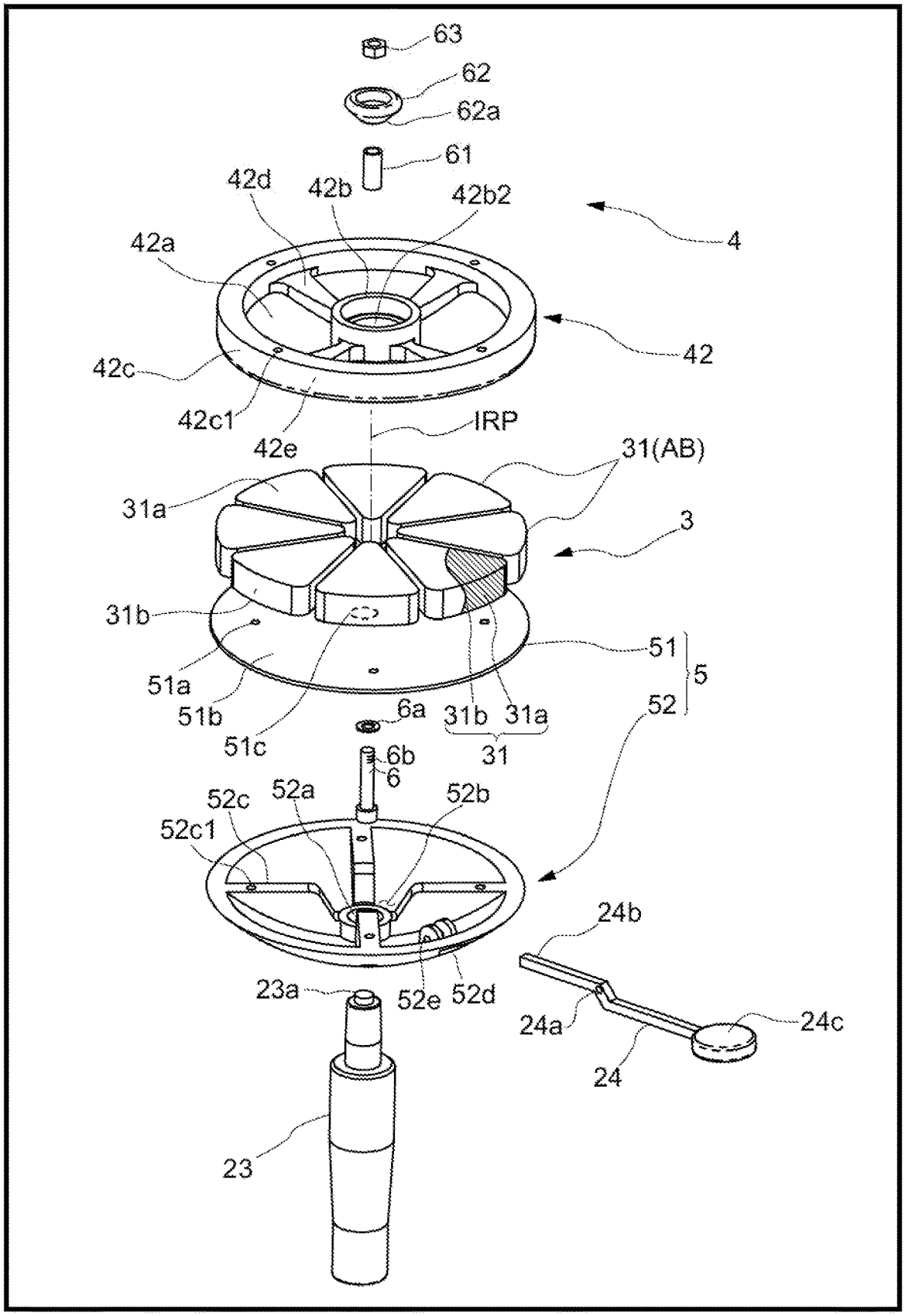
FIG. 3 is an exploded perspective view of main portions of the chair.

In a chair according to the present embodiment, as illustrated in FIGS. 1 to 3, a seat 1 configured to be tiltable in front-rear and left-right directions is rotatably supported by a leg 2 including a caster 2*a*.

The seat 1 includes an elastic support layer 3, an upper base unit 4 being an upper unit and a lower base unit 5 being a lower unit arranged so that the elastic support layer 3 is sandwiched between the upper unit and the lower unit, in which the seat 1 is tiltable in the front-rear direction or in the left-right direction.

The leg 2 includes the caster 2*a* at a lower end of a leg vane 21 and a leg supporting post 22 erected from a center part of the leg vane 21, and the leg supporting post 22 is configured to be raised and lowered by a gas spring 23.

The upper base unit 4 includes a seat body 41 and an upper plate 42 being attached to a bottom surface of the seat body 41 and contacting a top surface of the elastic support layer 3. In the case of the present embodiment, the seat body 41 includes a seat plate 41*a* and a cushion 41*b* placed on the seat plate 41*a*, the seat plate 41*a* is formed integrally with a back plate 51*a*, and the back plate 51*a* is also provided with a cushion 51*b* to forma back part 5. The top surface of the upper base unit 4 is set as a seating surface 4*a* on which a load is applied.

The upper plate 42 has a disk shape in a plan view, and is provided integrally with a plate-shaped part 42*a*, a boss part 42*b* located at a center part of the plate-shaped part 42*a*, an annular part 42*c* located on an outer circumference of the plate-shaped part 42*a*, and a rib 42*d* radially extending from the boss part 42*b* and being connected to the annular part 42*c*, all of which are made from a resin or the like. The plate-shaped part 42*a* has a substantially partially spherical shape or a substantially arcuate cross shape, in other words, a bowl shape or a protruding R shape that gently bulges downward, as illustrated in FIG. 4B and the like. A bottom surface 42*e* of the plate-shaped part 42*a* has a substantially partially spherical shape or a substantially arcuate cross shape, in other words, a bowl shape or a protruding R shape that gently bulges downward according to the shape of the plate-shaped part 42*a* described above, and the bottom surface 42*e* acts as a rolling surface when the upper plate 42 rolls above a below-described lower plate 51 via the elastic support layer 3. A screw insertion hole 42*c*1 is provided at an appropriate position in the annular part 42*c* and is used to connect the upper plate 42 and the seat body 41 placed on a top surface of the upper plate 42 by a screw.

Inside the boss part 42*b*, a bottom wall 42*b*1 is provided as illustrated in FIG. 4B and the like. An opening 42*b*2 is formed at a center part of the bottom wall 42*b*1, a part of the opening 42*b*2 defines a tapered surface 42*b*3 opening upward, and a tubular part 42*b*4 having an enlarged diameter is formed above the tapered surface 42*b*3. An extraction prevention member 62 of a below-described stopper shaft 6 is accommodated in the opening 42*b*2 so that the extraction prevention member 62 is movable freely.

The lower base unit 5 has a disk shape and is placed below the upper base unit 4. In the present embodiment, the lower base unit 5 includes the lower plate 51 having rigidity and contacting the bottom surface of the elastic support layer 3 and a seat receiver 52 attached below the lower plate 51. The seat receiver 52 has a mortar-shaped shape and includes, at a central part thereof, a hole 52*a* and a hollow part 52*b* through which an upper end part of the gas spring 23 is inserted. The lower plate 51 abuts against a rib 52*c* while securing a gap between the upper end part of the gas spring 23 and the lower plate 51, and the seat receiver 52 and the lower plate 51 are connected with screws by using a screw insertion hole 52*cl* provided in the rib 52*c* and a screw hole 51*a* provided in the lower plate 51.

An operation lever 24 is inserted from a hole 52*d* provided in a part of an outer circumference of the seat receiver 52, a fulcrum 24*a* of the operation lever 24 is supported by a bearing 52*e* of the seat receiver 52, and a proximal end 24*b* of the operation lever 24 is engaged with an input end 23*a* of the gas spring 23. The gas spring 23 is locked/unlocked by a vertical operation applied to an operation end 24*c* of the operation lever 24.

As illustrated in FIGS. 1 to 4, the elastic support layer 3 has a disk shape and includes a plurality of load support bodies 31 arranged around a predetermined tilt reference position IRP in a state of being sandwiched between the upper plate 42 configuring the upper base unit 4 and the lower plate 51 configuring the lower base unit 5. Airbags AB individually configured are employed for the load support bodies 31 of present embodiment. The tilt reference position IRP is a center position of the disk-shaped upper plate 42 configuring the above-described upper base unit 4, and a center position of the disk-shaped lower plate 51 configuring the lower base unit 5.

Each of the airbags AB configuring each of the load support bodies 31 is formed by wrapping a peripheral part of a resin foam elastic body 31*a* with a skin material 31*b*. A material having a higher elastic modulus than a low-resilience urethane, for example, a high-resilience urethane is employed for the resin foam elastic body 31*a*. The skin material 31*b* is formed of a porous sheet member sealed with a plain weave cloth. Of course, among familiar materials, it is possible to employ a material such as a material employed for a raincoat or an umbrella, which passes air with difficulty, but does not completely block air, but has some air permeability. For the skin material 31*b*, it is possible to employ a skin material obtained by adjusting air permeability by forming, in a sealing type film, a plurality or a large number of small holes allowing air to enter therein and exit therefrom appropriately. In any case, a preferable air permeability is about 300 to 400 s, but it is also effective to employ a skin material having air permeability of about 200 to 500 s. This air permeability was obtained by measuring a time during which 300 mL of air was discharged through JIS L 1096: 2010 "Testing methods for woven and knitted fabrics" 8.26.2 B method (Gurley method) test.

Thus, in the airbag AB of the present embodiment, the periphery of the resin foam elastic body 31*a* is covered with the skin material 31*b*, and required parts are sealed so that air does not flow in or out from parts other than the skin material 31*b*. Of course, the damper effect is determined by a balance between compression restoration characteristics of the resin foam elastic body 31*a* and an air inflow/outflow resistance of the skin material 31*b*, and is set by two load support body constitutive parameters, that is, elastic characteristics of the resin foam elastic body 31*a* and an air permeability of the skin material 31*b*.

Each of the airbags AB of the present embodiment has a fan shape in a plan view and a predetermined thickness, and the airbags AB are arranged radially around the tilt reference position IRP so that an even number of (eight in the present embodiment) vertices of the airbags AB gather. A top surface

31*a* of the airbag AB and the bottom surface 42*e* of the upper plate 42 included in the upper base unit 4, and a bottom surface 31*b* of the airbag AB and a top surface 51*b* of the lower plate 51 included in the lower base unit 5 are fixed with a double-sided tape or an adhesive not illustrated. Of course, these surfaces may be fixed with other means.

While the airbag AB included in the elastic support layer 3 is sandwiched between the upper plate 42 and the lower plate 51, the stopper shaft 6 is inserted through a center hole 51*c* of the lower plate 51 via a washer 6*a* from below and passed through an inside of a portion where the vertices of the airbags AB included in the elastic support layer 3 gather, and the stopper shaft 6 is covered with a collar 61 to be located at the passed portion. The stopper shaft 6 is configured so that a base end thereof is thick and a distal end thereof is attached with the extraction prevention member 62 having a tapered surface 62*a* engaged in a tapered manner with the tapered surface 42*b*3. When a nut 63 is screwed onto a screw 6*b* formed at an end of the stopper shaft 6 for fastening, the extraction prevention member 62 is fastened to the stopper shaft 6 via the collar 61. The collar 61 serves a role of remaining a distance between the lower plate 51 and the extraction prevention member 62 constant.

Thus, the upper base unit 4, the lower base unit 5, and the airbag AB configuring the elastic support layer 3 are inseparably and integrally coupled. In this state, the substantially entire surface of a rolling surface 42*e* contacts the elastic support layer 3. The rolling surface 42*e* is set over the substantially entire area of the upper base unit 4, but as long as a contact point via the elastic support layer 3 can be obtained between the rolling surface 42*e* and the lower base unit 5 in a tilting range in front-rear and left-right directions, the rolling surface 42*e* may not be set over the entire area.

At this time, the bottom surface 42*e* of the upper plate 42 bulges downward as illustrated in FIG. 4B and the like, and the airbag AB configuring the elastic support layer 3 is tightened in a state of being further compressed as the airbag AB comes closer to the tilt reference position IRP. When there is no load on the upper plate 42, the upper plate 42 is urged upward by an elastic repulsive force of the airbag AB configuring the elastic support layer 3, and when the tapered surface 62*a* of the extraction prevention member 62 of the stopper shaft 6 and the tapered surface 42*b*3 of the upper plate 42 are engaged in a tapered manner, the upper base unit 4 including the upper plate 42 is held at the highest position along the stopper shaft 6 in a predetermined horizontal or near-horizontal posture (reference posture).

Figure 4A:
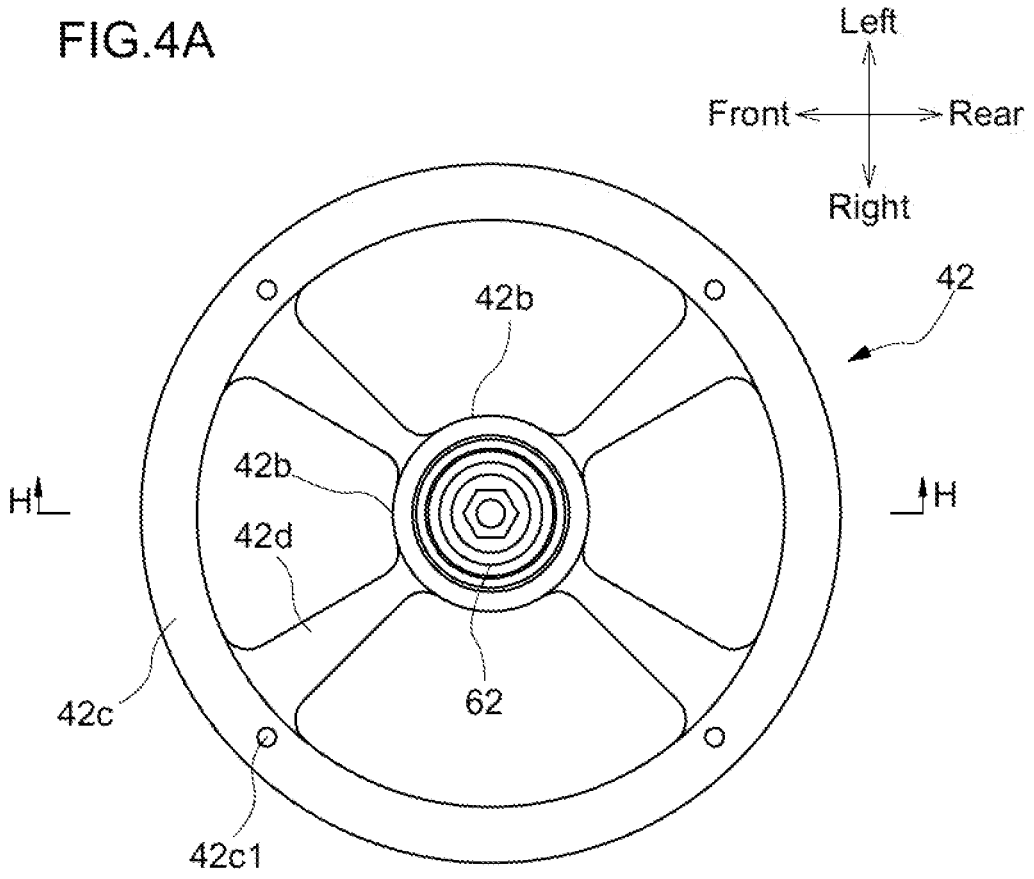
FIGS. 4A and 4B are diagrams for explaining a vertical movement and a tilting motion in a front-rear direction of an upper base unit included in the chair.
Figure 4B:
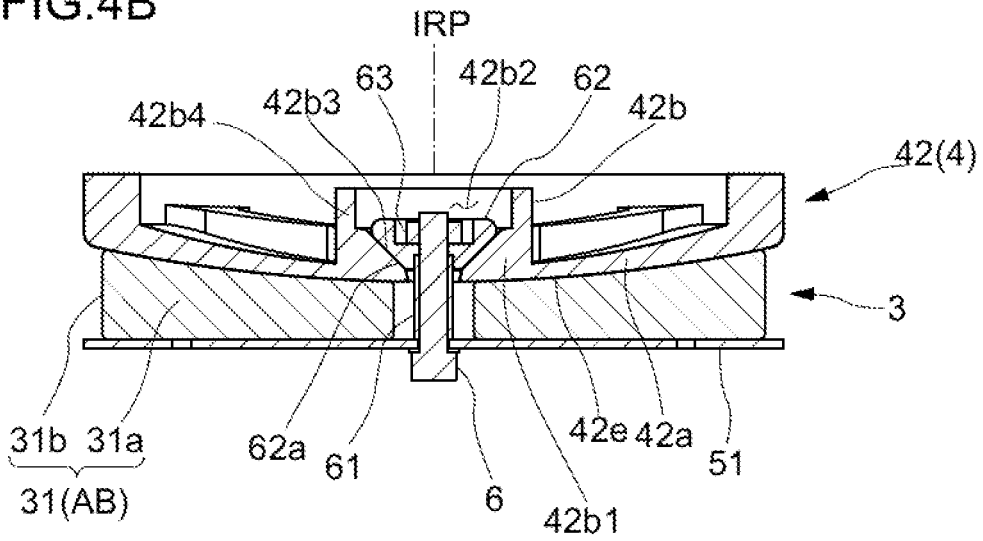
Figure 5A:
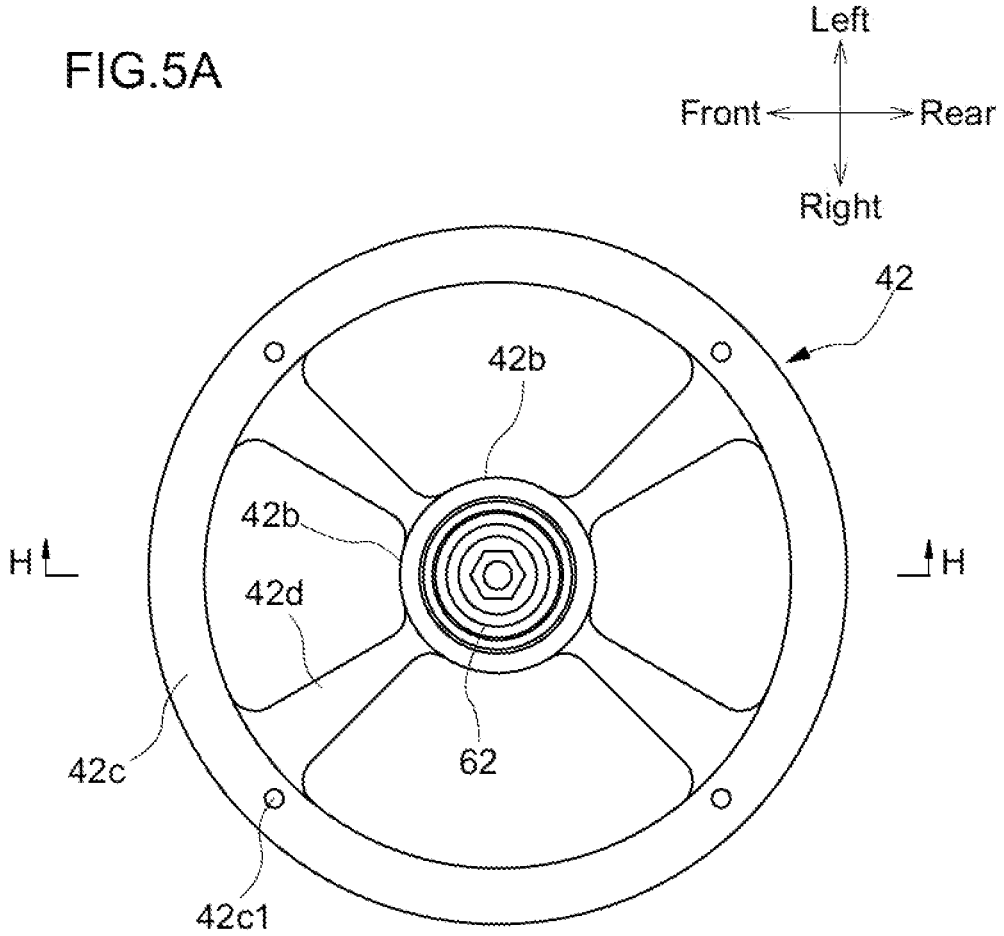
FIGS. 5A and 5B are the same diagrams as above.
Figure 5B:
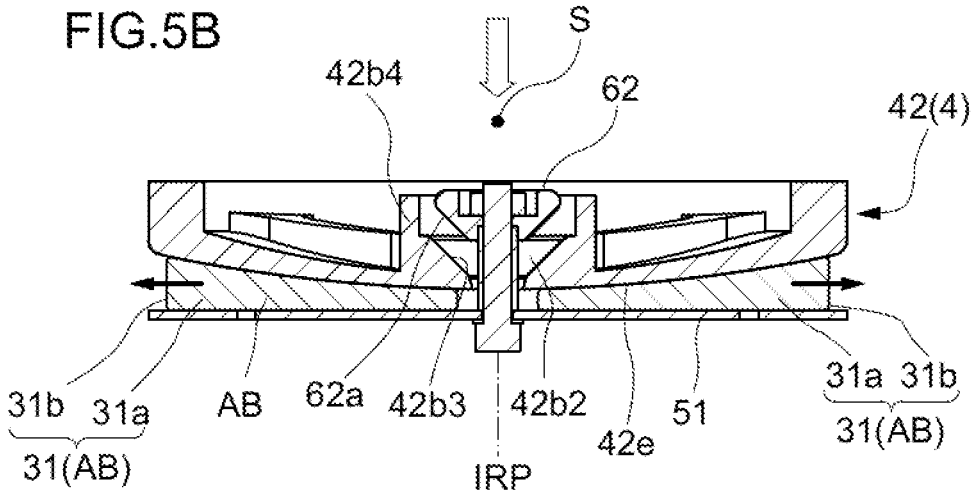
Figure 6A:
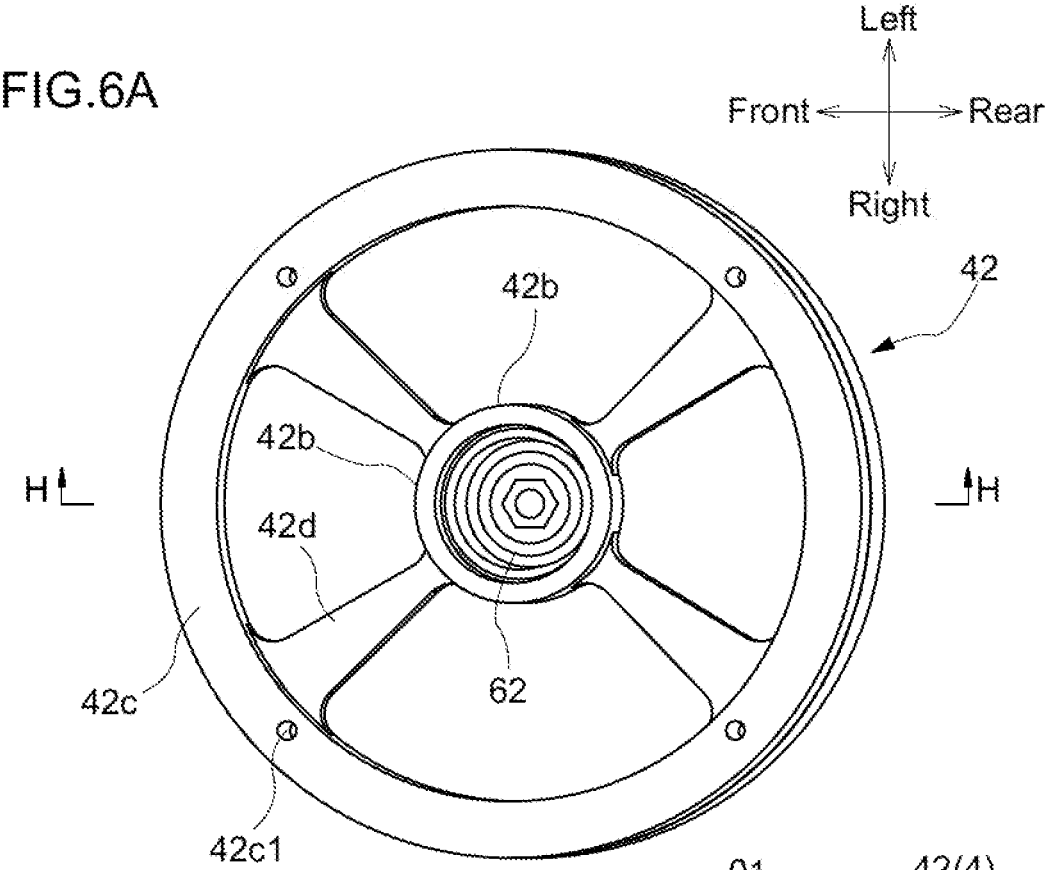
FIGS. 6A, 6B, and 6C are the same diagrams as above.
Figure 6B:
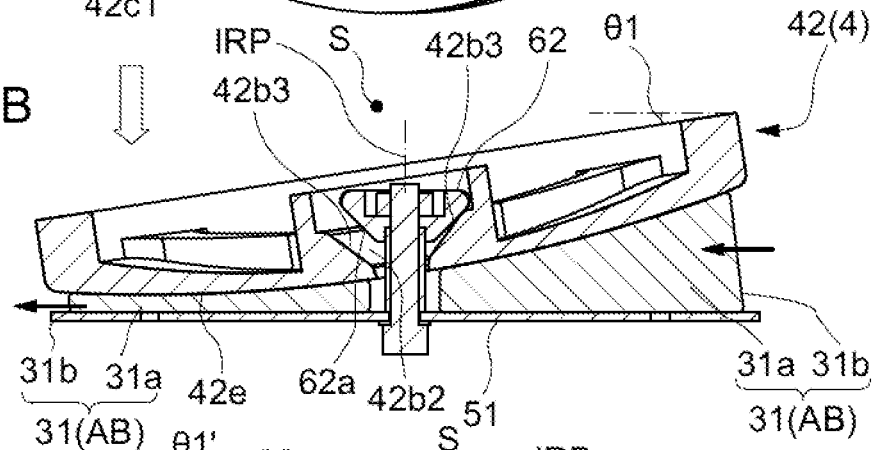
Figure 6C:
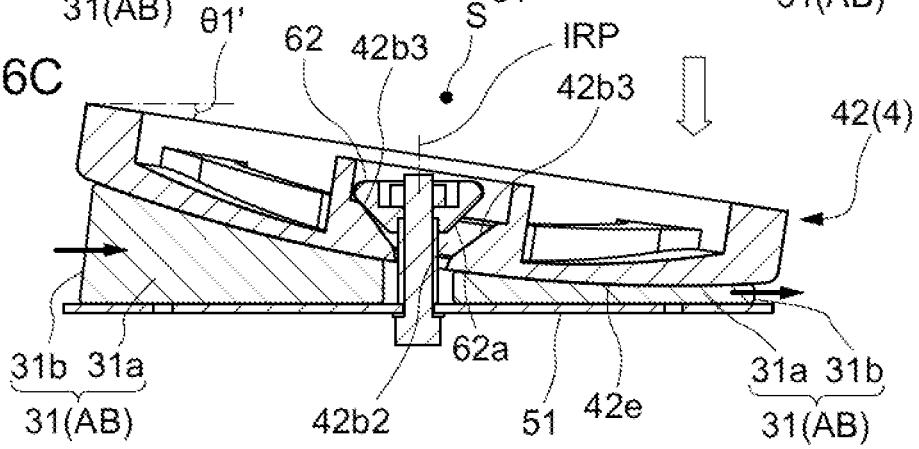

FIG. 4A is a plan view illustrating the upper plate 42 without a load of a seated person, and FIG. 4B is a cross-sectional view taken along a line H-H along the front-rear direction in FIG. 4A. FIG. 5A is a plan view illustrating the upper plate 42 with the load of the seated person applied to the tilt reference position IRP, and FIG. 5B is a cross-sectional view taken along the line H-H along the front-rear direction in FIG. 5A. FIG. 6A is a plan view of the upper plate 42 with the load of the seated person applied forward of the tilt reference position IRP, and FIG. 6B is a cross-sectional view taken along the line H-H along the front-rear direction in FIG. 6A. FIG. 6C is a cross-sectional view corresponding to FIG. 6B when the load of the seated person is applied rearward of the tilt reference position IRP.

When the load of the seated person is applied to the tilt reference position IRP from the state in FIG. 4B, the upper base unit 4 including the upper plate 42 descends straightly as illustrated in FIG. 5B, and the tapered surface 42*b*3 of the upper plate 42 is separated from the tapered surface 62*a* of the extraction prevention member 62. At this time, the front airbag AB and the rear airbag AB with respect to the tilt reference position IRP are evenly compressed. When the load of the seated person is removed, the upper base unit 4 including the upper plate 42 is risen straightly by a restoring force of the airbag AB, and at a point where the tapered surface 42*b*3 of the upper plate 42 is engaged in a tapered manner again to the tapered surface 62*a* of the extraction prevention member 62, the upper base unit 4 including the upper plate 42 is stopped and held in a predetermined horizontal or near-horizontal posture.

In the state of FIGS. 5A and 5B, the extraction prevention member 62 of the stopper shaft 6 is freely movable within the opening 42*b*2 of the upper plate 42 (including an inner peripheral edge of the tapered surface 42*b*3 and an inner peripheral edge of the tubular part 42*b*4 thereabove), and the upper base unit 4 including the upper plate 42 can perform a tilting motion (gliding motion) while freely balancing with the load of the seated person in the front-rear direction. Therefore, for example, if the load is transferred forward, the upper base unit 4 including the upper plate 42 rolls above the lower plate 51 via the airbag AB while compressing the front airbag AB, and as a result, the upper base unit 4 including the upper plate 42 is brought into a state where a front end is tilted downward and a rear end is tilted upward as illustrated in FIGS. 6A and 6B.

On the contrary, when the load is transferred rearward, the upper base unit 4 including the upper plate 42 rolls above the lower plate 51 via the airbag AB while compressing the rear airbag AB, and as a result, the upper base unit 4 including the upper plate 42 is brought into a state where the rear end is tilted downward and the front end is tilted upward as illustrated in FIG. 6C.

If the upper base unit 4 including the upper plate 42 tilts beyond a predetermined range in any direction, the inner peripheral edge of the opening 42*b*2 of the upper plate 42 (including the inner peripheral edge of the tapered surface 42*b*3 and the inner peripheral edge of a tubular part 42*c*4 thereabove) is engaged to the extraction prevention member 62 attached to an upper part of the stopper shaft 6, and as a result, the upper base unit 4 is restricted from tilting any further.

The extraction prevention member 62 of the stopper shaft 6 and the peripheral edges of the opening 42*b*2 of the upper plate 42 configure a tilt regulating mechanism.

When the seated person leaves the seat during tilting, the airbag AB is restored, and this allows the upper plate 42 to be urged upward and the seat 4 including the upper plate 42 to be risen, and thus, the tapered surface 42*b*3 of the upper plate 42 is engaged to the tapered surface 62*a* of the extraction prevention member 62 of the stopper shaft 6, and as a result, the upper base unit 4 including the upper plate 42 can return to a predetermined posture obtained when the seated person does not sit in a chair as illustrated in FIGS. 4A and 4B. As a result of the seat body 41 being integrally provided with the back part 5, even if a position of a center of gravity of the seat body 41 deviates from the tilt reference position IRP, it is possible to maintain a predetermined posture of the upper base unit 4 including the upper plate 42 by the above engagement in a tapered manner.

Under such engagement, the engagement in a tapered manner is retained unless the seated person sits in the chair, so that the back part 5 and the upper base unit 4 are held in a constant posture without losing the balance even when the chair is moved by putting a hand on the back part 5.

Figure 7A:
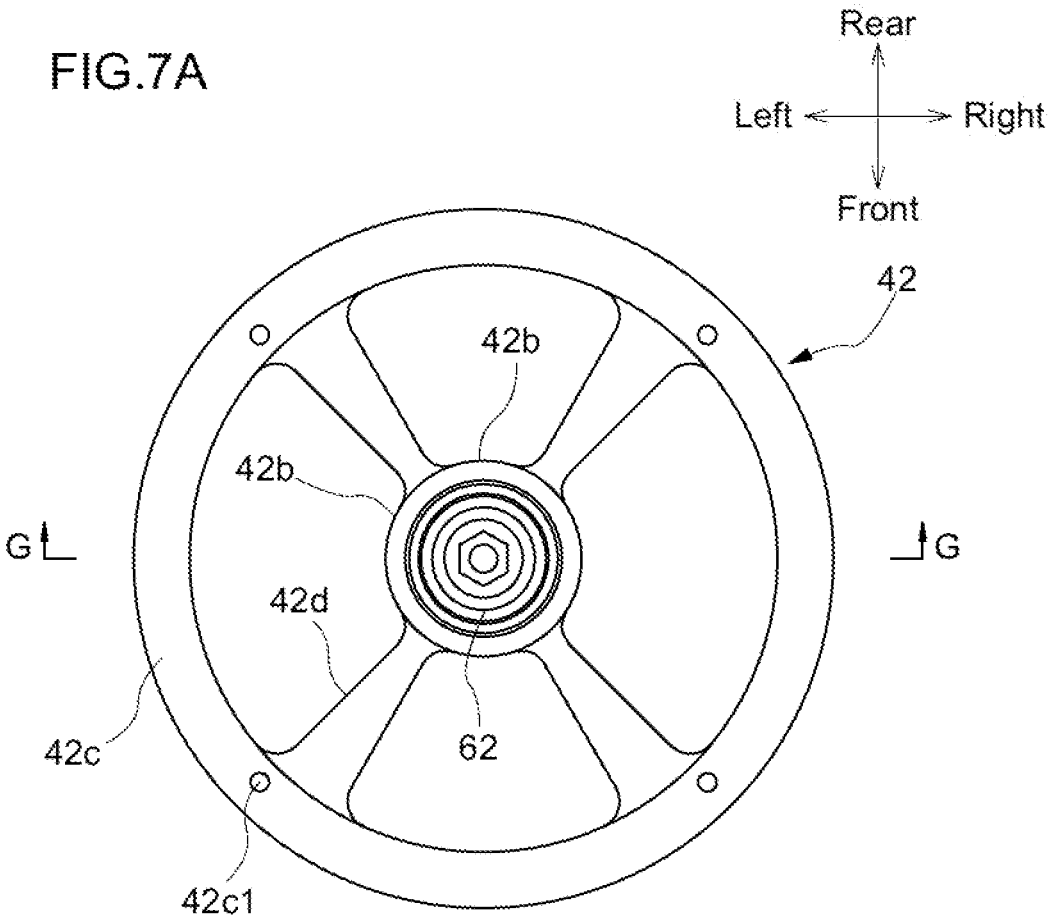
FIGS. 7A and 7B are diagrams for explaining a vertical movement and a tilting motion in a left-right direction of the upper base unit included in the chair.
Figure 7B:
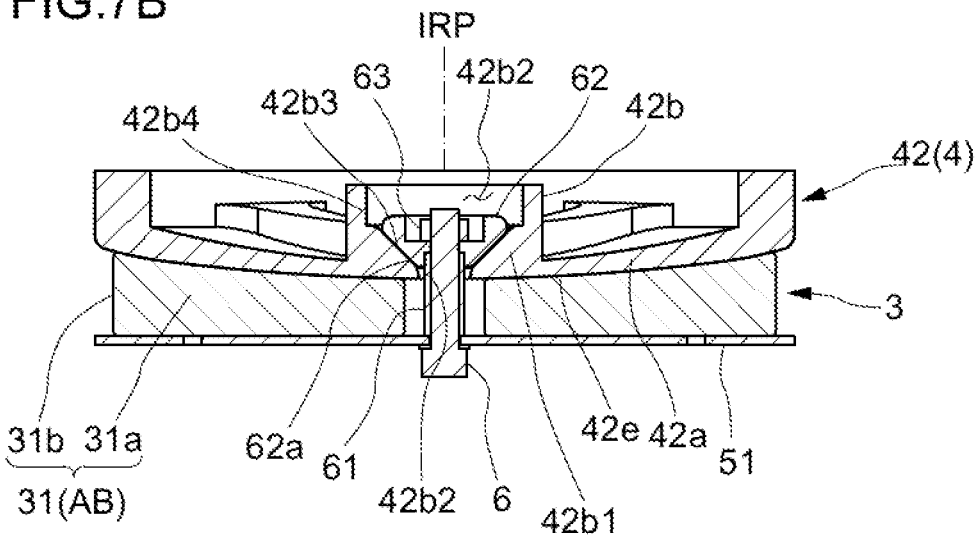
Figure 8A:
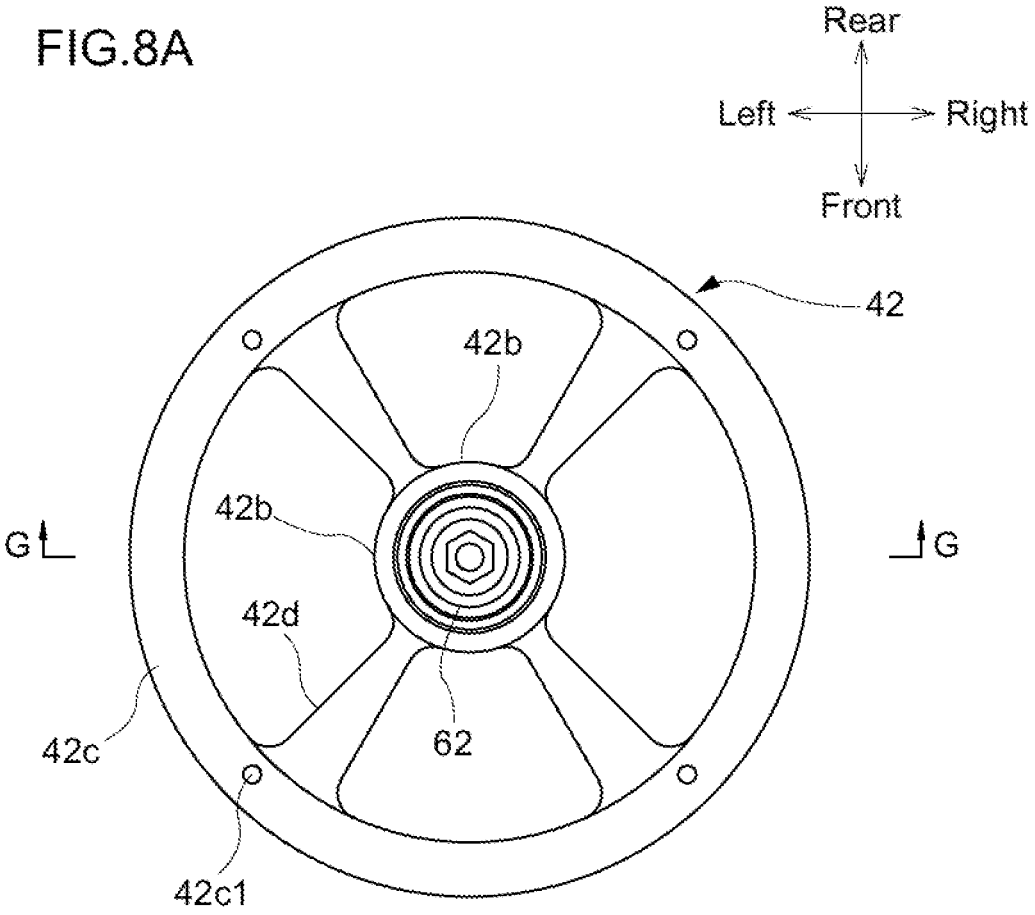
FIGS. 8A and 8B are the same diagrams as above.
Figure 8B:
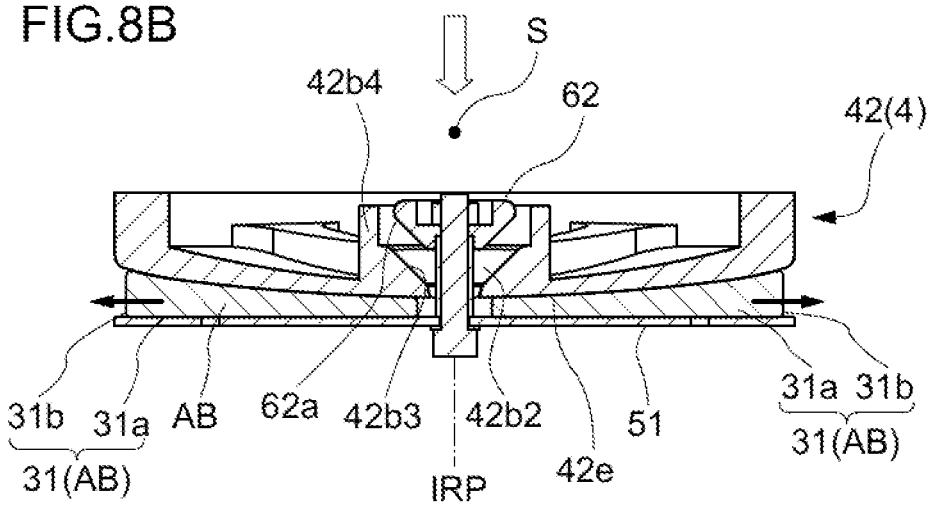
Figure 9A:
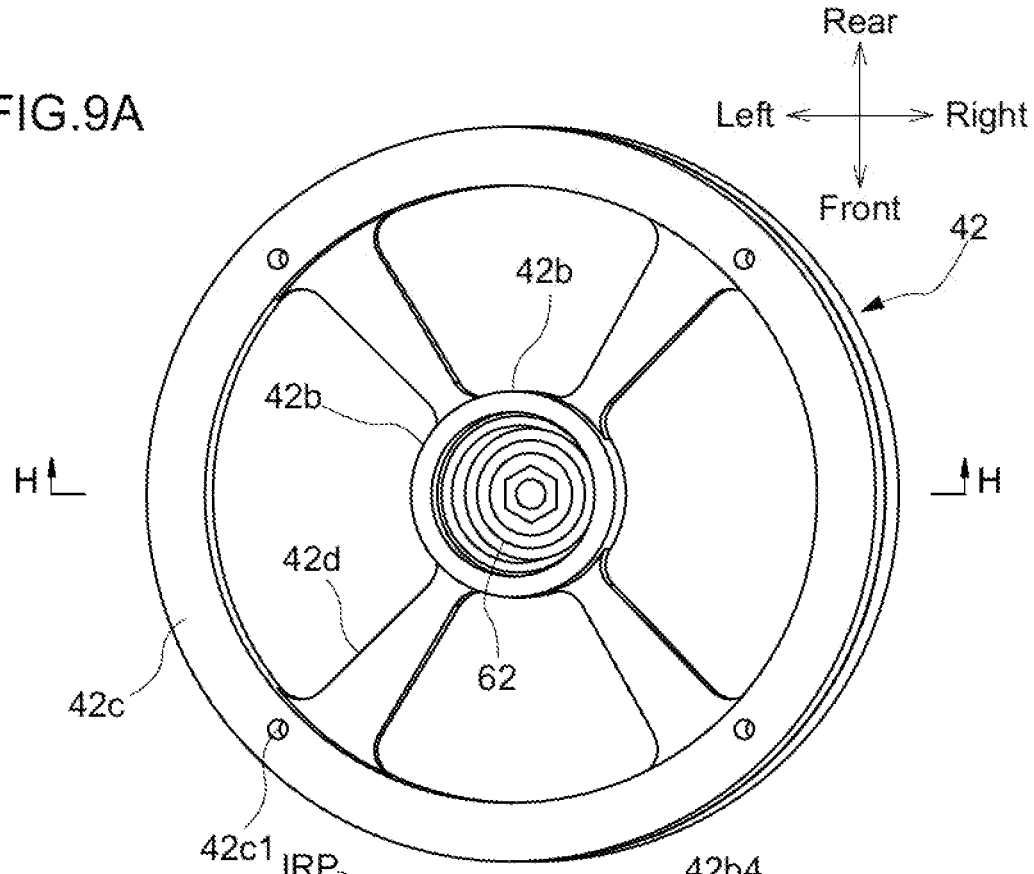
FIGS. 9A, 9B, and 9C are the same diagrams as above.
Figure 9B:
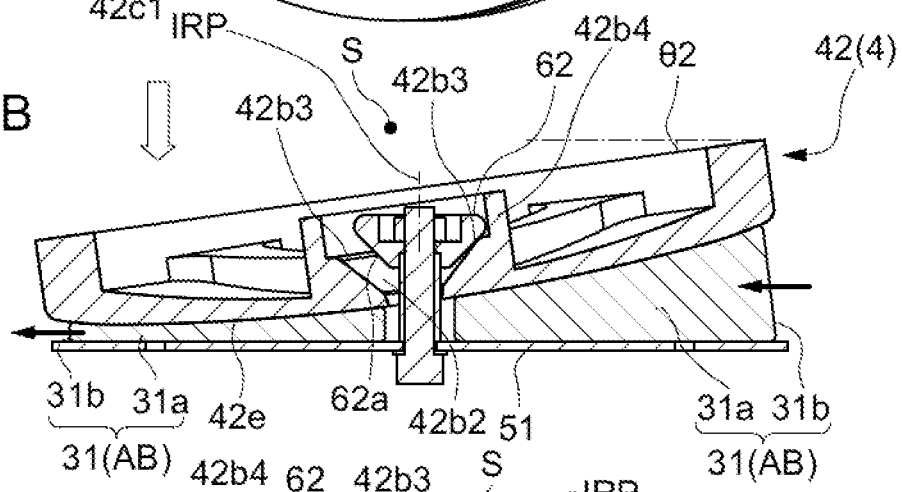
Figure 9C:
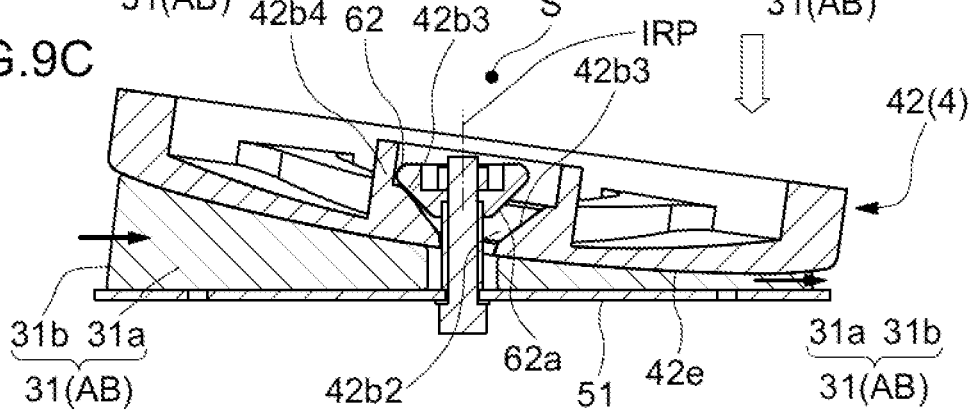

FIG. 7A is a plan view illustrating the upper plate 42 without a load of the seated person, and FIG. 7B is a cross-sectional view taken along a line G-G along the left-right direction in FIG. 7A. FIG. 8A is a plan view of the upper plate 42 with the load of the seated person applied to the tilt reference position IRP, and FIG. 8B is a cross-sectional view taken along the line G-G along the left-right direction in FIG. 8A. FIG. 9A is a plan view of the upper plate 42 with the load of the seated person applied to the left of the tilt reference position IRP, and FIG. 9B is a cross-sectional view taken along the line G-G along the left-right direction in FIG. 9A. FIG. 9C is a cross-sectional view corresponding to FIG. 9B when the load of the seated person is applied to the right of the tilt reference position IRP.

The description for FIGS. 7, 8, and 9 applies to the above description for FIGS. 4, 5, and 6 where "front" is replaced with "left" and "rear" is replaced with "right".

If such front-back and left-right motions occur in combination, it is possible to realize a motion where the upper base unit 4 including the upper plate 42 performs a rolling movement around the tilt reference position IRP.

The rolling surface 42*e* of the upper plate 42 bulges downward, and thus, a front end side in a moving direction tilts downward and a rear end side in the moving direction tilts upward when the upper plate 42 moves while rolling. A curvature of the rolling surface 42*e* is not always uniform at each part, but a rolling center is always set at a position higher than a center of gravity of a movable part including the upper base unit 4. Therefore, the center of gravity rises as the movable part moves from the tilt reference position IRP, and a returning force for returning to the tilt reference position IRP by gravity from a rolling destination is accumulated.

When there is a load on the seating surface 4*a*, the upper base unit 4 compresses the elastic support layer 3 and sinks, and at that time, the cushion 41*b* of the upper base unit 4 is also compressed. A position of a center of gravity of the entire movable part obtained by calculating a weighted average of a center of gravity of the movable part of the seat 1 including the upper base unit 4 and a center of gravity of a human body is represented by S in FIGS. 5B and 8B. In this state, the rolling center of the rolling surface 42*e* is also set to be higher than the center of gravity S. If the upper base unit 4 tilts in front-rear and left-right directions together with the seated person and the seat surface 4*a* from this position, as a ground contact point of the rolling surface 42*e* (more specifically, a ground contact point with respect to the lower plate 51 of the lower base unit 5 via the elastic support layer 3) moves, the center of gravity S moves from a position of FIG. 5B to a position of FIG. 6B or FIG. 6C while moving forward, rearward, left and right or moves from a position of FIG. 8B to a position of FIG. 9B or FIG. 9C, and at this time, the center of gravity S is lifted in a height direction. When the center of gravity Sis lifted, a gravity returning force toward the tilt reference position IRP is accumulated as a positional energy in the upper base unit 4 and the movable part including the seated person.

With such a gravity return mechanism, the seated person can basically safely perform a swinging motion in front-rear and left-right directions while balancing with gravity even if the elastic support layer 3 is not included in the seat 1, and can stably sit in a predetermined tilting position. The elastic support layer 3 mainly serves to exert a damper effect when the seated person suddenly moves, and has a function to slowly return the upper base unit 4 to the tilt reference position IRP when the elastic support layer 3 is restored, but does not include an elastic force to establish a good balance with the load of the seated person only with the elastic support layer 3.

When the airbag AB contracts, the internal air flows out from the inside through the skin material 31*b*, and when the airbag AB expands, the external air flows in through the skin material 31*b*. Due to an inflow/outflow resistance at this time, the upper base unit 4 moves more slowly than a case where only the resin foam elastic body 31*a* is employed, for example. This action is also called a damper action or a delay action.

For example, if a user sits so that the center of gravity is located at the tilt reference position IRP, a compressive force is evenly applied to each of the airbags AB, and the upper plate 42 descends straightly from a state of FIG. 4B to a state of FIG. 5B. Along with this, the resin foam elastic body 31*a* in the airbag AB is compressed and contracted, and at this time, the interval air evenly flows out from the inside through the skin material 31*b* (see an arrow in FIG. 5B). Along with this, the upper base unit 4 integrally including the upper plate 42 and the upper plate 42 slowly descends.

When the load of the seated person is removed, the resin foam elastic body 31*a* configuring the airbag AB expands as a result of the restoration motion, and along therewith, the external air flows in through the skin material 31*b*. Here, an air flows in a direction opposite to an arrow in FIG. 5B, and the upper plate 42 returns to the state of FIG. 4B.

On the other hand, if the user sits so that the center of gravity is located at a position displaced in the front-rear direction from the tilt reference position IRP as illustrated in FIG. 6B or FIG. 6C, the airbag AB on a side where the center of gravity is located is compressed and contracted, and conversely, the airbag AB on an opposite side is expanded and inflated. Therefore, the compressed airbag AB allows more air to flow out from the inside than a state before the airbag AB is compressed (see an arrow in a direction away from the tilt reference position IRP), and the inflated airbag AB allows air to flow in from the outside (see an arrow in a direction toward the tilt reference position IRP). The air flows in and out mainly on a side surface of the airbag AB because the top surface 31*a* and the bottom surface 31*b* of the airbag AB are blocked by the upper plate 42 and the lower plate 51.

Thus, as a result of the seated person moving his or her body in the front-rear and left-right directions with respect to the lower base unit 5, when the upper base unit 4 tilts in the front-rear and left-right directions with respect to the tilt reference position IRP in accordance with the movement of the seated person, the contraction motion, the inflation motion, and the restoration motion of the resin foam elastic body 31*a* for each the airbags AB provide a constant delay effect due to the inflow and the outflow of the air through the skin material 31*b*, and as a consequence, the posture of the seated person is safely supported. The "delay effect" as used herein means an effect of delaying the tilting motion in the front-back and left-right directions due to the flow resistance of air or the like.

Such a delay effect is stronger when the seated person moves fast than when the seated person moves slowly to provide an effect of preventing the upper base unit 4 from inadvertently moving in the front-rear and left-right directions, and as a result, the elastic support layer 3 works also as a safety device of the upper base unit 4 capable of tilting in the front-rear and left-right directions.

In present embodiment, as illustrated in FIG. 1, a chair main body 3 is not a round chair, but includes the seat main body 41 with a backrest 31*a*, and thus, has a definite seating direction. Therefore, the rolling surface 42*e* may be set so that a curvature differs between the front-rear direction and the left-right direction such that the rolling surface 42*e* sways more largely in the front-rear direction than in the left-right direction.

More specifically, it is possible to realize the curvatures different between the front-rear direction and the left-right direction by differing a shape of a cross section of the rolling surface 42*e* along each of the front-rear direction and the left-right direction from each other.

For example, it is possible to realize an asymmetric tilting state between the front-back determined and the left-right direction by differing an inclination θ1 of the upper plate 42 in FIG. 6B and an inclination θ2 of the upper plate 42 in FIG. 9B. For example, when θ1>θ2, the upper plate 42 tilts gently in a relatively limited range in the left-right direction, whereas the upper plate 42 tilts significantly in a relatively wide range in the front-back direction. Thus, it is possible to set so that the upper plate 42 is tilted in a wide range in the front-back direction to allow for a free sway, and the upper plate 42 is tilted in a limited range in the left-right direction to enhance a feeling of support. In this case, a size, a material, and a shape of the resin foam elastic 31*a* configuring the airbag AB and an air permeability of the skin material 31*b* may be differed between the front-rear direction and the left-right direction.

Further, the rolling surface 42*e* may be set so that curvatures of the rolling surface 42*e* are differed between the front and the rear such that a rearward sway is larger than a forward sway. For example, if a relationship between θ1 in FIG. 6B and θ1' in FIG. 6C is θ1<θ1', the rear tilts more largely than the front, and thus, a rearwardly tilted position is achieved to relax the seated person. In this case also, the size, the material, and the shape of the resin foam elastic 31*a* configuring the airbag AB and the air permeability of the skin material 31*b* may be differed between the front and the rear.

As described above, the seat 1 of the present embodiment includes the elastic support layer 3 and the upper base unit 4 and the lower base unit 5 arranged so that the elastic support layer 3 is sandwiched therebetween. The upper base unit 4 includes the rolling surface 42*e* which bulges toward the lower base unit 5 and is arranged above the lower base unit 5 via the elastic support layer 3, is rollable in a 360° direction from the tilt reference position IRP in receiving a load of the seated person, and moves while compressing the elastic support layer 3 by the rolling surface with tilting the moving distal end side more downward as a distance from the tilt reference position IRP increases.

With this configuration, in the upper base unit 4, the rolling surface 42*e* bulging downward rolls above the lower base unit 5, and thus, the upper base unit 4 can move relatively widely while rolling continuously and smoothly in the front-rear and left-right directions according to the movement of the seated person. This allows the seated person to perform a stable tilting motion while balancing a load of the seated person on the rolling surface 42*e*, resulting in ensured safety. Moreover, the moving distal end side of the upper base unit 4 tilts downward, and thus, it is possible to follow the natural posture change of the seated person.

The seat 1 according to the present invention has a simple structure in which the elastic support layer 3 is only sandwiched between the upper base unit 4 and the lower base unit 5. The elastic support layer 3 is sandwiched between the both base units 4 and 5, and therefore, the upper base unit 4 rolls on the elastic support layer 3, and as a result, as compared to a case where the upper base unit 4 rolls directly on the lower base unit 5, it is possible to provide a softer sitting feel and also prevent an abnormal noise from occurring. As the moving distal end side tilts downward, the elastic support layer 3 is compressed, and thus, even with the structure where the upper base unit 4 easily rolls due to the rolling surface 42*e*, the damper effect of the elastic support layer 3 allows for ensured safety and prevents a situation where the upper based unit 4 cannot return from a rolling destination, and as a result, the upper base unit 4 can be appropriately returned to the tilt reference position IRP by utilizing an elastic restoration motion of the elastic support layer 3.

The center of gravity 8 of the upper base unit 4 rises as a distance from the tilt reference position IRP increases, and thus, it is possible to automatically return the upper base unit 4 to the tilt reference position IRP by gravity.

A substantially entire surface of the rolling surface 42*e* contacts the elastic support layer 3, and thus, the elastic support layer 3 is compressed in any direction. A speed of compressing the elastic support layer 3 is increased as the upper base unit 4 tilts more largely, and as a result, it is possible to increase the damper effect.

The curvatures of the rolling surface 42*e* may be differed between the front-rear direction and the left-right direction. The seated person sways differently between the front-rear direction and the left-right direction, and thus, it is possible to realize an appropriate sway of the upper base unit 4 according to the movement of the seated person through such a difference in curvature.

The rolling surface 42*e* may have curvatures different between the front and the rear. The body of the seated person sways differently between the front and the rear, and thus, it is possible to realize an appropriate sway of the upper base unit 4 according to the movement of the seated person through such a difference in curvature.

The elastic support layer 3 is provided with a damper effect, and thus, it is possible to improve safety by absorbing an impact and delaying the movement of the movable part including the upper base unit 4 with respect to the movement of the seated person.

When the elastic support layer 3 is configured by the load support body 31 (airbag AB) in which the resin foam elastic body 31*a* is wrapped with a breathable skin material 31*b*, it is possible to utilize the inflow and outflow of the air to ensure a required amount of compressive deformation and an appropriate tilting range of the upper base unit 4 as compared to a case where the air is confined.

If elastic characteristics of the resin elastic foam body 31*a* configuring the elastic support layer 3 and an air permeability of the skin material 31*b* are appropriately set, even without using a temperature-dependent or humidity-dependent material such as a memory foam mat, it is possible to adjust the elastic support layer 3 to have a moderate cushioning property that is neither too soft nor too hard and a damper action (shift action). As a result, it is possible to realize the seat 1 having an excellent cushioning property obtained when the seated person sits in a chair and having excellent shock-absorbing characteristics and stability by gently following a movement of the seated person.

The elastic support layer 3 includes the plurality of load support bodies 31, and thus, it is possible to independently define a region where a damper effect is produced to avoid a situation where air moves only inside the elastic support layer 3, and to realize an appropriate support state for each of the load support bodies 31, and as a result, it is possible to appropriately support a load movement in front-rear and left-right directions through cooperation of each of the load support bodies 31.

Each of the load support bodies 31 has a fan shape in a plan view and is arranged radially around the tilt reference position IRP to configure the elastic support layer 3, and thus, when the load support bodies 31 are laid out with no gaps, it is possible to provide an appropriate damper effect in any swing direction.

The elastic support layer 3 includes a plurality of layers on top of one another and the load support bodies 31 configuring each layer are arranged with a pitch shifted in a circumferential direction around the tilt reference position IRP, and thus, it is possible to prevent the load support bodies 31 from losing their shape and provide sufficient thickness while preventing rattling during operation to increase the damper function.

A load support body constitutive parameter such as a size of the resin foam elastic body 31*a*, a material thereof, a shape thereof, and an air permeability of the skin material 31*b* may differ between the load support bodies 31 arranged in the front and rear directions and the load support bodies 31 arranged in the left and right directions, and thus, it is possible to freely set tilting characteristics in the front-back and left-right directions.

The top surface 31*a* of each of the load support bodies 31 is fixed to the upper base unit 4 and the bottom surface 31*b* of each of the load support bodies 31 is fixed to the lower base unit 5. If a force acts in a rotation direction between the upper base unit 4 and the lower base unit 5 due to a movement of a body of the seated person and a structure of a chair such as a rotary chair, it is possible to prevent the load support body 31 from deviating or peeling because of the above configuration.

The upper base unit 4 is configured to sink while compressing the elastic support layer 3 when receiving a load of the seated person, and thus, it is possible to alleviate the shock when the seated person sits in the chair.

The seat 1 is configured such that the opening 42*b*2 is provided at a central part of the upper base unit 4, the stopper shaft 6 is provided in the lower base unit 5, the stopper shaft 6 is inserted into the opening 42*b*2, the stopper shaft 6 is freely movable relatively within the opening 42*b*2, and if the upper base unit 4 is tilted beyond a predetermined tilting range, the stopper shaft 6 abuts against a peripheral edge of the opening 42*b*2. Therefore, it is possible to appropriately regulate an excessive tilting motion while allowing for free tilting of the upper base unit 4 in a normal situation.

Further, the seat 1 is configured such that the opening 42*b*2 is provided at a central part of the upper base unit 4, the stopper shaft 6 is provided in the lower base unit 5, the stopper shaft 6 is inserted into the opening 42*b*2, the extraction prevention member 62 arranged on the stopper shaft 6 engages with the peripheral edge of the opening 42*b*2 to function as a stopper when the upper base unit 4 separates from the lower base unit 5 during elastic restoration of the elastic support layer 3. Thus, it is possible to realize a motion of the upper base unit 4 sinking toward the lower base unit 5 and appropriately regulate an ascending motion of the upper base unit 4 when the seated person leaves the seat.

When the peripheral edge of the opening 42*b*2 and the extraction prevention member 62 of the stopper shaft 6 are engaged in a tapered manner, the upper base unit 4 is positioned at a predetermined posture, and thus, it is possible to easily impart a posture holding function when the seated person leaves the seat.

If the chair is configured to include the above-described seat 1, it is possible to appropriately support the tilting motion of the seated person in the front-back and left-right directions with a simple structure, and as a result, it is possible to realize a chair having an excellent cushioning property when the seated person sits in the chair and having excellent shock-absorbing characteristics and stability by gently following the movement of the seated person.

If the above-described seat 1 is employed, it is also possible to realize a similar effect in a chair with the seat 1 supported by the leg 2 having the caster 2*a*.

If the above-described seat 1 is employed, it is also possible to realize a similar function in a chair with the seat 1 supported by the leg 2 and the lower base unit 5 arranged on the upper end side of the leg 2.

If the load support body 31 is formed by wrapping the non-low-resilience resin foam elastic body 31*a* with the breathable skin material 31*b* and the load support body 31 includes a plurality of the load support bodies 31 arranged at positions to dispersedly support the load, it is possible to independently define a region where a damper effect is produced, to avoid a situation where air moves only inside the elastic support layer 3, and to appropriately support a load transfer in the front-rear and left-right directions through cooperation with each of the load support bodies 31.

In particular, if the air permeability of the skin material 31*b* is in the range of 200 to 500 s, it is possible to obtain an appropriate delay effect.

Although an embodiment of the present invention was explained above, the specific configuration of each component is not limited to those in the embodiment described above.

For example, in the above embodiment, the elastic support body 31 included in the elastic support layer 3 is formed of the airbag AB obtained by wrapping the high-resilience resin foam elastic body 31*a* with the breathable skin material 31*b* to obtain the required damper effect and delay effect, but a low-resilience resin foam elastic body may be employed.

In the above embodiment, the configuration in which the damper effect and the delay effect are exhibited is employed, but when such effects are not particularly required, a normal high-resilience elastic body alone, that is, a normal high-resilience elastic body not wrapped with a skin material may be employed In the above embodiment, the elastic support layer 3 mainly includes the resin foam elastic body 31*a*, but all or part of the elastic support layer 3 may be formed of a spring.

In the above embodiment, the opening 42*b*2 is provided in the upper base unit 4 and the stopper shaft 6 is provided in the lower base unit 5, but an opening may be provided in the lower base unit 5 and a stopper shaft may be provided in the upper base unit 4.

In the above embodiment, the upper plate 42 is arranged immediately below the seat body 41, but the upper plate 42 may be provided at a position separated downward from the seat body 41.

In the above embodiment, the upper base unit 4 includes the seat body 41 and the upper plate 42 and the top surface of the seat body 41 is used as a seating surface, but the upper base unit 4 may include only the upper plate 42 and the top surface of the upper plate 42 may be used as the seating surface.

In the above embodiment, the upper base unit 4 is provided with the rolling surface, but the lower base unit 5 may be provided with the rolling surface.

Figure 10A:
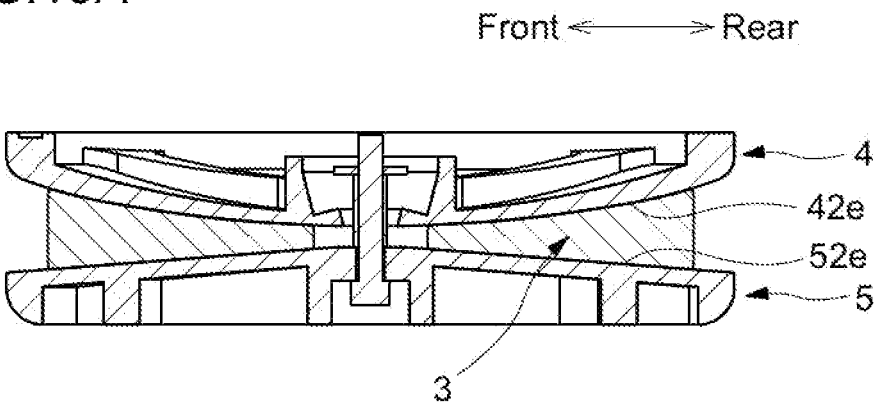
FIGS. 10A and 10B are diagrams illustrating a modification of the present invention.
Figure 10B:
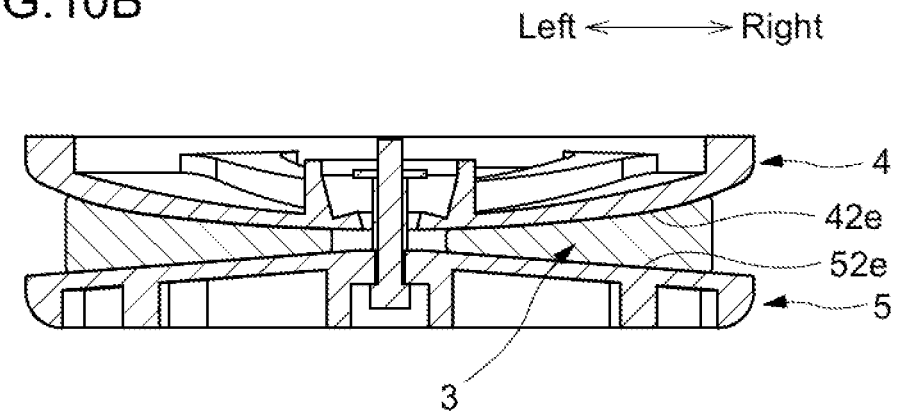

In the above embodiment, the rolling surface is provided only in the upper base unit 4, but as illustrated in FIG. 10, the upper base unit 4 and the lower base unit 5 may include rolling surfaces 42*e* and 52*e* bulging toward each other, and the upper base unit 4 may be configured to move while compressing the elastic support layer 3 between the rolling surfaces 42*e* and 52*e*.

Thus, the tilt angle of the upper base unit 4 can further increase even in a narrow space.

In the above embodiment, the configuration is described in which the seat main body configuring the upper base unit is formed integrally with the backrest, and the present invention may also apply to a round chair with a seating direction being omnidirectional.

Figure 11:
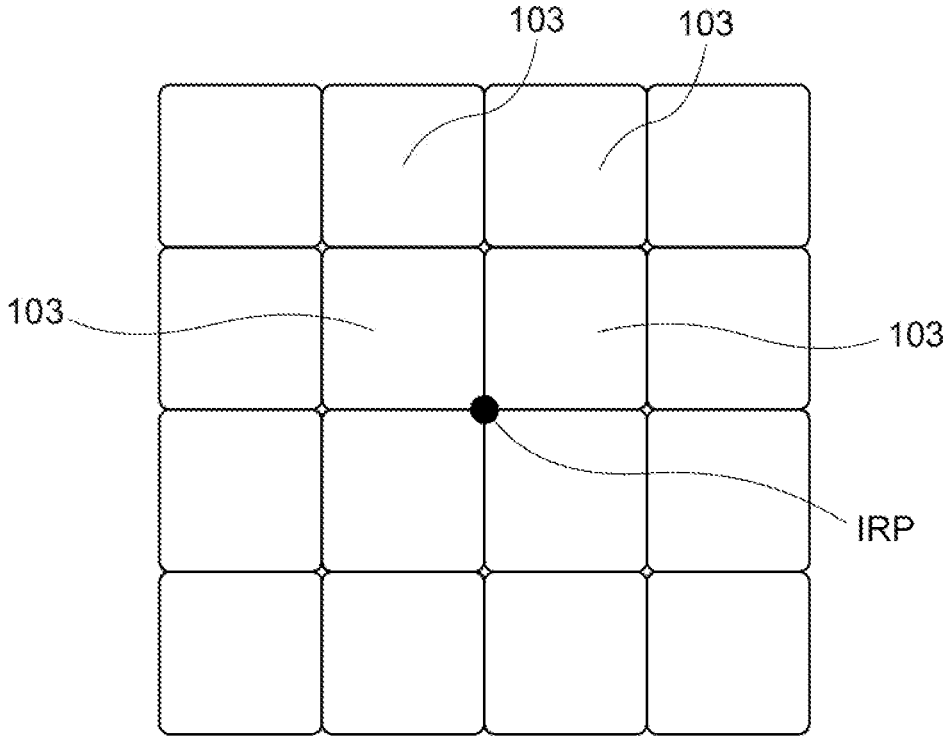
FIG. 11 is a diagram illustrating a modification of the present invention.

As illustrated in FIG. 11 corresponding to FIG. 4, an elastic support layer 103 may be arranged in a matrix to surround the tilt reference position IRP. Such a configuration is effective, for example, when the upper plate 42 included in the upper base unit 4 and the lower plate 51 as illustrated in FIG. 3 do not have a disk shape but a quadrangular shape.

Figure 12:
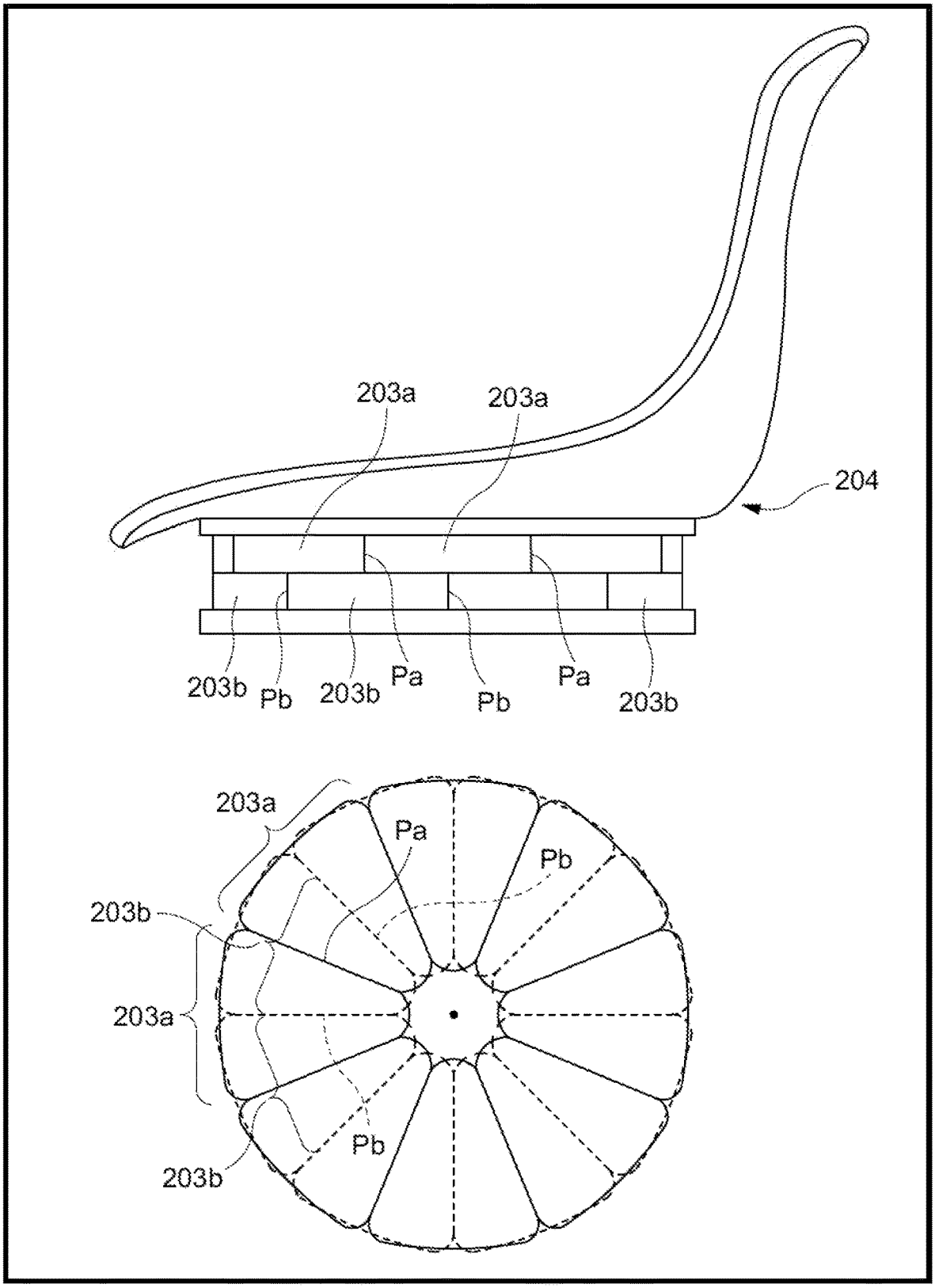
FIG. 12 is a diagram illustrating a modification of the present invention.

As illustrated in FIG. 12, it is also effective that the elastic support layer is formed in a structure having a plurality of vertical stages in which first-stage elastic support layers 203*a* are stacked on second-stage elastic support layers 203*b*, and a seam Pa between the elastic support layers 203*a* and 203*a* and a seam Pb between the elastic support layers 203*b* and 203*b* are provided to displace between the upper-stage side and the lower-stage side in a circumferential direction.

Thus, with the plurality of vertical stages, an amount of deformation of the upper base unit 204 may be increased to enhance a cushioning property. At that time, when phases of the upper and lower elastic support layers 203*a* and 203*b* are shifted in the circumferential direction, the seam Pb between the elastic support layers 203*b* and 203*b* is located on a surface of each of the elastic support layers 203*a*, the seam Pa between the elastic support layers 203*a* and 203*a* is located on a surface of each of the elastic support layers 203*b*, and as a result, it is possible to prevent the seam portions Pa and Pb from losing the shape and suppress rattling during operation to eliminate discomfort when a seated person sits in a chair.

Various other modifications may be applied to other configurations without departing from the gist of the present invention.

For example, in the above embodiment, the elastic body included in the elastic support layer is divided into a plurality of parts, but the whole of the elastic body may be configured as an integral body.

In the above embodiment, the chair to which the seat is applied is described, but the present invention includes a case where the seat is used alone. Also in this case, if the center of gravity of the movable part including the upper base unit when a user is not seated in the chair is set to be lower than a rolling center of the rolling surface, and if the total center of gravity obtained by calculating a weighted average of the center of gravity of the movable part including the upper base unit when the user is seated and the center of gravity of the seated person are set to be lower than the rolling center of the rolling surface, it is possible to secure a gravity return function.

REFERENCE SIGNS LIST

1 . . . Seat
3 . . . Elastic support layer
4 . . . Upper base unit
4*e* . . . Bottom surface
5 . . . Lower base unit
6 . . . Stopper shaft
31 . . . Load support body
31*a* . . . Resin foam elastic body
31*b* . . . Skin material
42*b*2 . . . Opening
62 . . . Extraction prevention member
IRP . . . Tilt reference position
S . . . Center of gravity

What is claimed is:

1. A seat comprising: an elastic support layer, and an upper base unit and a lower base unit arranged to sandwich the elastic support layer, wherein in at least one of the upper base unit and the lower base unit, a rolling surface bulging toward the other of the upper base unit and the lower base unit is arranged above the other of the upper base unit and the lower base unit via the elastic support layer, and the upper base unit is rollable in a 360° direction from a tilt reference position in receiving a load of a seated person, has a moving distal end side tilting more downward as a distance from the tilt reference position increases, and moves while compressing the elastic support layer by the rolling surface, the rolling surface has different curvatures between a front-rear direction and a left-right direction.

2. The seat according to claim 1, wherein a center of gravity rises as a distance from the tilt reference position increases.

3. The seat according to claim 1, wherein a substantially entire surface of the rolling surface contacts the elastic support layer.

4. The seat according to claim 1, wherein the upper base unit and the lower base unit have rolling surfaces bulging toward each other, and the upper base unit moves between the rolling surfaces while compressing the elastic support layer.

5. A chair comprising the seat according to claim 1.

6. A seat comprising: an elastic support layer; and an upper base unit and a lower base unit arranged to sandwich the elastic support layer, wherein in at least one of the upper base unit and the lower base unit, a rolling surface bulging toward the other of the upper base unit and the lower base unit is arranged above the other of the upper base unit and the lower base unit via the elastic support layer, and the upper base unit is rollable in a 360° direction from a tilt reference position in receiving a load of a seated person, has a moving distal end side tilting more downward as a distance from the tilt reference position increases, and moves while compressing the elastic support layer by the rolling surface, the rolling surface has different curvatures between a front and a rear.

7. The seat according to claim 6, wherein a center of gravity rises as a distance from the tilt reference position increases.

8. The seat according to claim 6, wherein a substantially entire surface of the rolling surface contacts the elastic support layer.

9. The seat according to claim 6, wherein the upper base unit and the lower base unit have rolling surfaces bulging toward each other, and the upper base unit moves between the rolling surfaces while compressing the elastic support layer.

10. A chair comprising the seat according to claim 6.

11. A seat comprising: an elastic support layer; and an upper base unit and a lower base unit arranged to sandwich the elastic support layer, wherein in at least one of the upper base unit and the lower base unit, a rolling surface bulging toward the other of the upper base unit and the lower base unit is arranged above the other of the upper base unit and the lower base unit via the elastic support layer, and the upper base unit is rollable in a 360° direction from a tilt reference position in receiving a load of a seated person, has a moving distal end side tilting more downward as a distance from the tilt reference position increases, and moves while compressing the elastic support layer by the rolling surface, the elastic support layer has a damper effect, wherein the elastic support layer is configured by arranging a plurality of load support bodies.

12. The seat according to claim 11, wherein the elastic support layer is configured by the load support bodies obtained by wrapping a resin foam elastic body with a skin material having breathability.

13. The seat according to claim 11, wherein each of the load support bodies has a fan shape in a plan view, and the elastic support layer is configured by arranging each of the load support bodies radially around the tilt reference position.

14. The seat according to claim 13, wherein the elastic support layer includes a plurality of layers on top of one another, and load support bodies configuring the layers are arranged around the tilt reference position with a pitch shifted in a circumferential direction.

15. The seat according to claim 11, wherein a load support constitutive parameter including a size, a material, a shape of the resin foam elastic body and an air permeability of the skin material is different between a load support body arranged in the front and rear directions and a load support body arranged in the left and right directions.

16. A chair comprising the seat according to claim 11.

* * * * *